US008517083B2

(12) United States Patent
Bracher

(10) Patent No.: US 8,517,083 B2
(45) Date of Patent: Aug. 27, 2013

(54) SYSTEM, APPARATUS AND METHOD FOR MANUFACTURING METAL INGOTS

(75) Inventor: Douglas Bracher, Downingtown, PA (US)

(73) Assignee: Refractory Specialties, Incorporated

( * ) Notice: Subject to any disclaimer, the term of this patent is extended or adjusted under 35 U.S.C. 154(b) by 935 days.

(21) Appl. No.: 12/335,401

(22) Filed: Dec. 15, 2008

(65) Prior Publication Data

US 2009/0155539 A1 Jun. 18, 2009

Related U.S. Application Data

(60) Provisional application No. 61/013,706, filed on Dec. 14, 2007, provisional application No. 61/021,698, filed on Jan. 17, 2008.

(51) Int. Cl.
*B22D 7/06* (2006.01)
*B22D 7/10* (2006.01)

(52) U.S. Cl.
USPC ..... 164/123; 164/137; 249/197; 249/201

(58) Field of Classification Search
USPC ..... 164/123, 137; 249/105, 106, 112, 249/113, 135, 197, 201, 202
See application file for complete search history.

(56) References Cited

U.S. PATENT DOCUMENTS 3,436,883 A * 4/1969 Charman, Jr. et al. ..... 52/127.1
3,749,628 A * 7/1973 Nancarrow et al. ..... 156/313
3,888,298 A * 6/1975 Cooley et al. ..... 164/137
4,037,644 A * 7/1977 Tarmann et al. ..... 164/61
5,567,536 A 10/1996 Lintz et al.
5,569,629 A 10/1996 TenEyck et al.
5,580,532 A 12/1996 Robinson et al.
5,585,312 A 12/1996 TenEyck et al.
5,666,726 A 9/1997 Robinson et al.
5,767,022 A 6/1998 Clere et al.
5,811,063 A 9/1998 Robinson et al.
5,834,120 A 11/1998 Murray et al.
5,874,375 A 2/1999 Zoitos et al.
5,989,736 A 11/1999 Lintz et al.
6,025,288 A 2/2000 Zoitos et al.
6,030,910 A 2/2000 Zoitos et al.
6,112,488 A 9/2000 Olson et al.
6,128,874 A 10/2000 Olson et al.
6,231,818 B1 5/2001 TenEyck
6,248,677 B1 6/2001 Dowding et al.
6,447,906 B1 9/2002 Andrejcak et al.
6,855,298 B2 2/2005 TenEyck
6,953,757 B2 10/2005 Zoitos et al.
(Continued)

*Primary Examiner* — Kevin P Kerns
(74) *Attorney, Agent, or Firm* — The Belles Group, P.C.

(57) ABSTRACT

A mold for creating metal ingots, a hottop sideboard and a system and method of manufacturing metal ingots utilizing the same. A hottop sideboard utilizes a layer of a rigid refractory material integrally connected to a layer a flexible refractory material that is compressed between the rigid layer and the sidewalls of the mold during use. The mold for creating metal ingots comprises: a main body having a floor and sidewalls that form a cavity for receiving a molten metal; a plurality of sideboards connected to the sidewalls and forming a perimeter about the cavity in a spaced relation from the floor, the sideboards comprising a first layer of a rigid refractory material and a second layer of a flexible refractory material, the first layer and the second layer being connected to one another; and the sideboards are secured to the sidewalls so that the second layer is compressed between the first layer and the sidewall.

13 Claims, 6 Drawing Sheets

(56) References Cited

U.S. PATENT DOCUMENTS

| | | | |
|---|---|---|---|
| 7,033,412 | B2 | 4/2006 | Kumar et al. |
| 7,413,797 | B2 | 8/2008 | de Souza |
| 7,468,336 | B2 | 12/2008 | Zoitos et al. |
| 7,468,337 | B2 | 12/2008 | Zoitos et al. |
| 7,767,597 | B2 | 8/2010 | Garvey |
| 7,829,036 | B2 | 11/2010 | Kumar et al. |
| 7,887,917 | B2 | 2/2011 | Zoitos et al. |
| 7,971,357 | B2 | 7/2011 | Ten Eyck et al. |
| 7,998,422 | B2 | 8/2011 | Ten Eyck et al. |
| 8,007,732 | B2 | 8/2011 | Beauharnois |
| 8,017,085 | B2 | 9/2011 | Fernandes, Jr. |
| 8,075,843 | B2 | 12/2011 | Kumar |
| 8,182,752 | B2 | 5/2012 | Ten Eyck et al. |
| 8,211,373 | B2 | 7/2012 | Olson et al. |
| 8,263,512 | B2 | 9/2012 | Fernando et al. |
| 8,349,265 | B2 | 1/2013 | Beauharnois |
| 8,404,187 | B1 | 3/2013 | Fernando et al. |
| 2008/0181587 | A1 | 7/2008 | Patil et al. |
| 2008/0234123 | A1 | 9/2008 | Patil et al. |

* cited by examiner

SYSTEM, APPARATUS AND METHOD FOR MANUFACTURING METAL INGOTS

CROSS-REFERENCE TO RELATED PATENT APPLICATIONS

The present application claims the benefit of U.S. Provisional Patent Application 61/013,706, filed Dec. 14, 2007, and U.S. Provisional Patent Application 61/021,698, filed Jan. 17, 2008, the entireties of which are hereby incorporated by reference.

FIELD OF THE INVENTION

The present invention relates generally to the field of manufacturing metal ingots, and specifically to hottop sideboard apparatus and molds, systems and methods of using the same in the manufacture of metal ingots.

BACKGROUND OF THE INVENTION

The manufacture of steel ingots through the use of cast iron molds is well known in the art. Referring first to FIG. 1, a typical prior art method and system for manufacturing steel ingots from molten steel will be generally described. A cast iron mold 1 of the desired size and shape is first supplied. The walls 2 and floor 3 of the cast iron mold 1 form a cavity 4 having an open top end for receiving molten steel, which can be poured into the cast iron mold 1 while at temperatures over 1,000 degrees Fahrenheit. Existing cast iron molds 1, and the corresponding ingot manufacturing methods, are specially designed to allow heat to dissipate from the molten steel evenly from all sides.

First, the molten steel is poured into the cavity 4 of the cast iron mold 1. As the poured steel cools within the cast iron mold 1, the steel goes from the molten state to a solid shape. Naturally, the steel contracts during the cooling process. Thus, in order to create a solid steel ingot of uniform shape and high integrity, manufacturers attempt to maintain a molten steel head which feeds the solidifying and shrinking ingot body so as to achieve an ingot that has a consistent/uniform shape with as few cracks and/or voids as possible.

In order to achieve a uniform thermal cooling of the molten steel, steel ingot manufacturers typically utilize an insulating material 5 to cover the top surface of the molten steel and the mold walls of the cast iron mold 1. The most common insulating material used in the industry to cover the mold walls is a rigid refractory hottop sideboard material, which is applied to the mold walls of the cast iron mold 1 as sideboards 7.

An insulating powder is typically applied to the top surface of the molten steel at the remaining interface between the air and the molten steel. The insulting powder is applied so as to form a layer having a uniform thickness across the top surface of the molten steel. The thickness of the insulating powder layer is dictated by the thermal conductivity properties of the cast iron mold 1 and other variables.

However, during the pouring process, molten steel can infiltrate through gaps and cracks between the rigid refractory hottop sideboard and the mold wall, and also through gaps and irregularities within the rigid refractory hottop sideboard.

As the molten steel cools (and naturally contracts) the material near the walls 2 of the cast iron mold 1 has a tendency to shrink away from the sides of the mold walls 2, thereby leaving behind a gap where steel and refractory defects and irregularities in the surface and shape of the steel ingot and may form exogenous and unwanted defects. These defect are commonly referred to in the art as "fins."

These fins of steel create a defect in the ingot that either: (1) cause the entire ingot to be scrapped; or (2) require machining and/or grinding down of the ingot by hand to remove the fins from the ingot and correct the defect. This type of defect is believed to be the second largest cause of defects and loss of money in the manufacture of steel ingots in the melt shop at a steel mill. The cost to manufacture a steel ingot is approximately 50 cents per pound, and each steel ingot can cost $5,000.00. The excessive work to repair fin defects can cause the parts to be totally scrapped. In total this defect can cost a typical melt shop at a steel mill more than $1,000,000 per year.

In an attempt to remedy the "fin" problem, steel mills began to incorporate sideboards 7 into the cast iron mold 1. The sideboards 7 are typically connected to the sidewalls 2 of the cast iron mold 1 at or near the top of the cavity 4 that received the molten steel. Existing sideboards 7 are constructed of a rigid refractory material, such as ceramic fiber board. These sideboards are commonly referred to in the art as "hottops."The exact height of the sideboard 7 is chosen so that when the molten steel is initially poured into the cast iron mold 4, the surface level of the molten steel bath is surrounded by the sideboard 7. Typically, the surface level of the molten steel bath is at about the midpoint of the height of the inner surface 8 of the sideboard 7. Therefore, as the molten steel contracts and moves down the inner surface 8 of the sideboard 7, it is intended that a clean transition at the edges of the cooled steel ingot be achieved, thereby eliminating and/or reducing the occurrence of fins.

Referring now to FIG. 2, a top view of a the prior art sideboard 7 connected to the sidewall 2 of the cast iron mold 1 is schematically illustrated. As can be seen, the inner surfaces 9 of the sidewalls 2 of the cast iron mold 1 are typically corrugated (i.e., have an undulating surface). The corrugated surface is utilized to in order to increase the surface area of the steel ingot to be formed, which in turn increases thermal cooling, thereby reducing manufacturing time. The outer surface 10 of the rigid sideboard 7 is formed to match the corrugation of the inner surface 9 of the sidewalls 2 of the cast iron mold 1. Nails 11 or other fasteners are typically used to hold the sideboard 7 in place.

However, with continued use, the contour of the inner surface 9 of the sidewalls 2 of the cast iron mold 1 (and/or the contour of the outer surface 10 of the sideboard 7) becomes irregular. If there is not a tight fit between the inner surface 9 of the sidewall 2 and the outer surface 10 of the sideboard 7, the molten steel may penetrate even the smallest gap between the two, thereby resulting in "fins" during the cooling process.

Thus, extensive efforts have been undertaken to try to ensure that the rigid sideboards 7 are perfectly fitted to the sidewalls 2 of the cast iron mold 1. This is generally achieved by requiring extremely tight tolerances for the size and shape of the outer surface 10 of the sideboard 7. The need for such tight tolerances exponentially increases the cost of manufacturing the sideboards 7. Nonetheless, even when the desired tolerances are achieved, "fins" continue to appear during the manufacturing process, especially over time and continued use the same cast iron mold.

SUMMARY OF THE INVENTION

It is therefore an object of the present invention to provide a system, method and apparatus for manufacturing metal ingots that reduces the occurrence of unwanted fins and/or other irregularities.

Another object of the present invention is to provide a hottop sideboard that reduces the occurrence of unwanted fins and/or other irregularities during the cooling process.

Still another object of the present invention is to provide a hottop sideboard that eliminates the need for overly tight manufacturing tolerances and/or is cheaper to manufacture.

Yet another object of the present invention is to provide a system, method and apparatus for manufacturing metal ingots that reduces waste and/or scrap.

A further object of the present invention is to provide a method of manufacturing a hottop sideboard that is simple, effective, and/or inexpensive manner, and/or that solves the problems related to fins in the art of manufacturing steel ingots.

These and other objects are met by the present invention, which in one aspect is a hottop sideboard that comprises an inner layer of a rigid refractory material and an outer layer of a flexible refractory material that can be compressed between the layer of rigid refractory material and a sidewall of an ingot mold. Preferably the inner layer of the rigid refractory material and the outer layer of the flexible refractory material are integrally connected to one another so as to form a monolithic structure.

In one embodiment, the inner layer of the rigid refractory material can be a ceramic fiber board and the outer layer of the flexible refractory material can be a ceramic fiber blanket.

The use of the two layers allows the thickness of the layers to be easily adjusted during the manufacturing process to provide a wide range of thermal insulating properties that closely adhere to the sidewalls of the cast iron mold.

In another aspect, the invention can be a steel ingot mold comprising: a structure having a floor and a wall surface that forms a cavity; and a hottop sideboard connected to the wall surface of the structure, the hottop sideboard comprising a layer of a rigid refractory material and layer of a flexible refractory material, the flexible refractory material compressed between the layer of rigid refractory material and the wall surface of the structure.

In yet another aspect, the invention can be a method manufacturing steel ingots utilizing the inventive steel ingot mold described above.

In still another aspect, the invention can be a mold for creating metal ingots comprising: a main body having a floor and sidewalls that form a cavity for receiving a molten metal; a plurality of sideboards connected to the sidewalls and forming a perimeter about the cavity in a spaced relation from the floor, the sideboards comprising a first layer of a rigid refractory material and a second layer of a flexible refractory material, the first layer and the second layer being connected to one another; and the sideboards are secured to the sidewalls so that the second layer is compressed between the first layer and the sidewall.

In another aspect, the invention can be a method of manufacturing metal ingots comprising: a) providing a mold comprising a main body having a floor and sidewalls that form a cavity; b) providing a plurality of sideboards comprising a first layer of a rigid refractory material and a second layer of a flexible refractory material, the first layer and the second layer being connected to one another; c) securing the sideboards to the sidewalls so as to form a perimeter about the cavity in a spaced relation from the floor, the sideboards secured to the sidewalls so that the second layer is compressed between the first layer and the sidewall; d) pouring molten metal into the cavity until a surface level of the molten metal is above a bottom edge of the sideboards and below a top edge of the sideboard; e) covering the surface level of the molten metal with an insulating powder; and f) allowing the molten metal to cool.

In a further aspect, the invention can be a hottop sideboard comprising: a first layer of a rigid refractory material; and a second layer of a flexible refractory material connected to the first layer of the rigid refractory material.

DETAILED DESCRIPTION OF THE INVENTION

Figure 1:
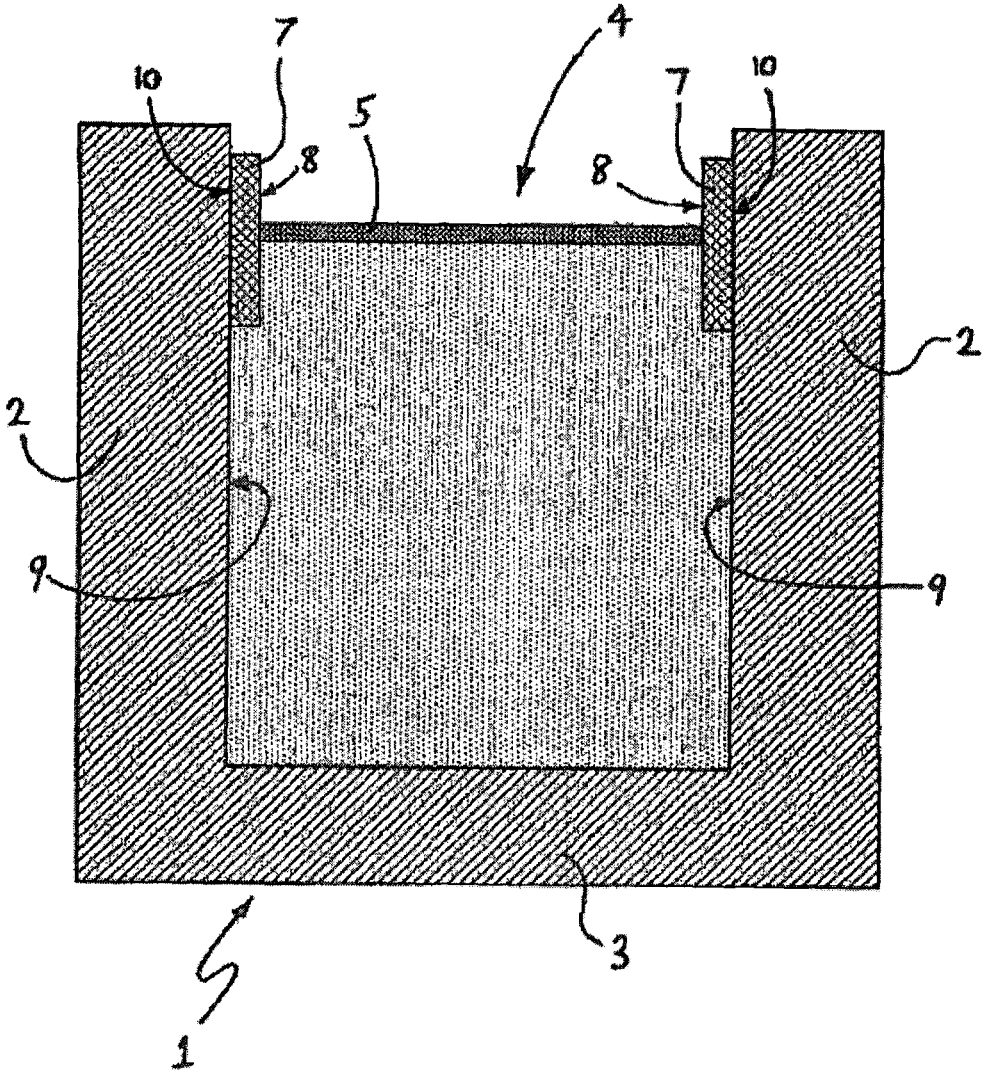
Figure 1 (Prior Art)
FIG. 1 is a cross-sectional schematic of a prior art cast iron mold for manufacturing steel ingots.
Figure 2:
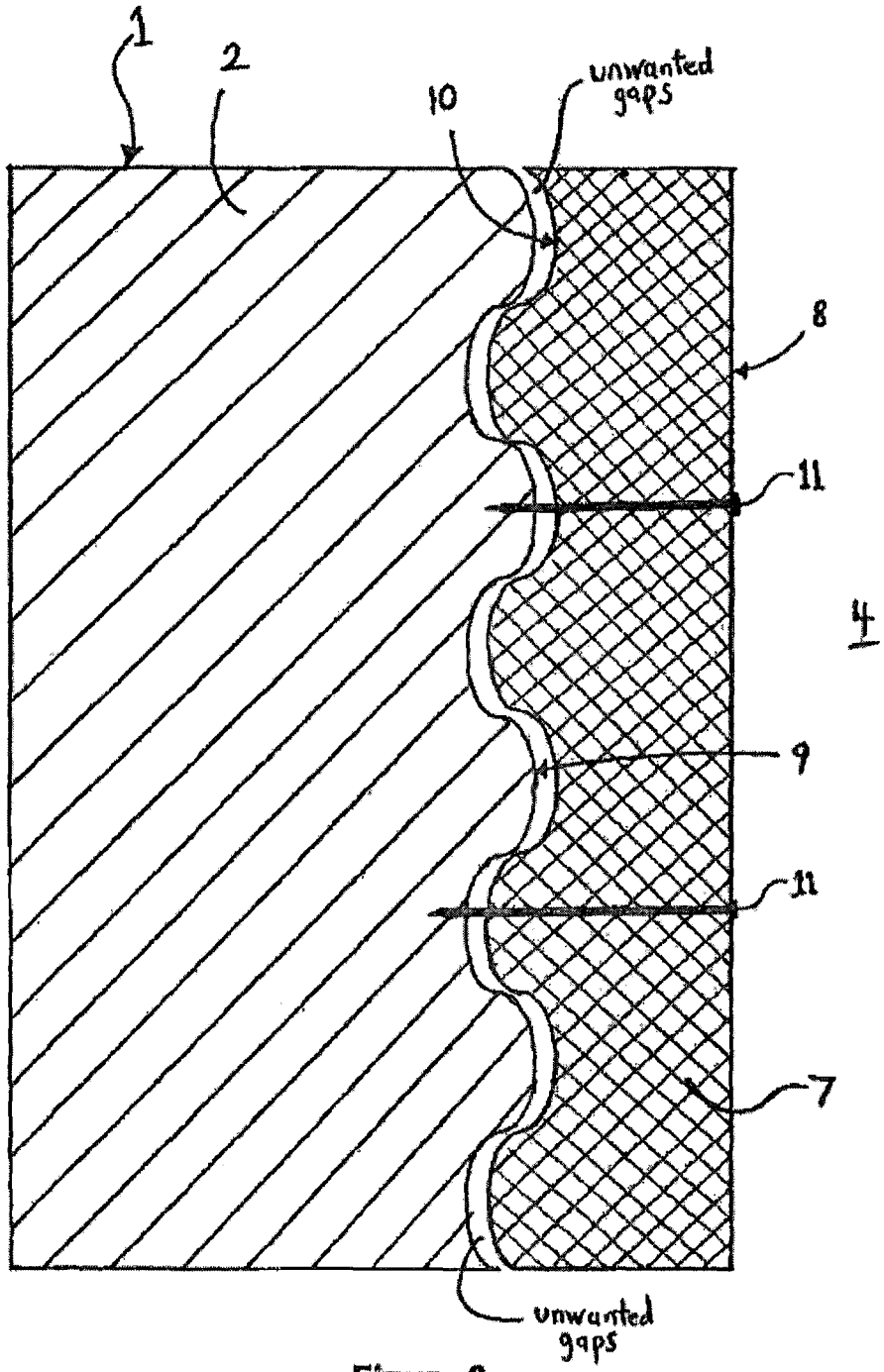
Figure 2 (Prior Art)
FIG. 2 is a section of the prior art cast iron mold of FIG. 1 showing the detail of the connection between the sidewall and the prior art hottop sideboard.
Figure 3:
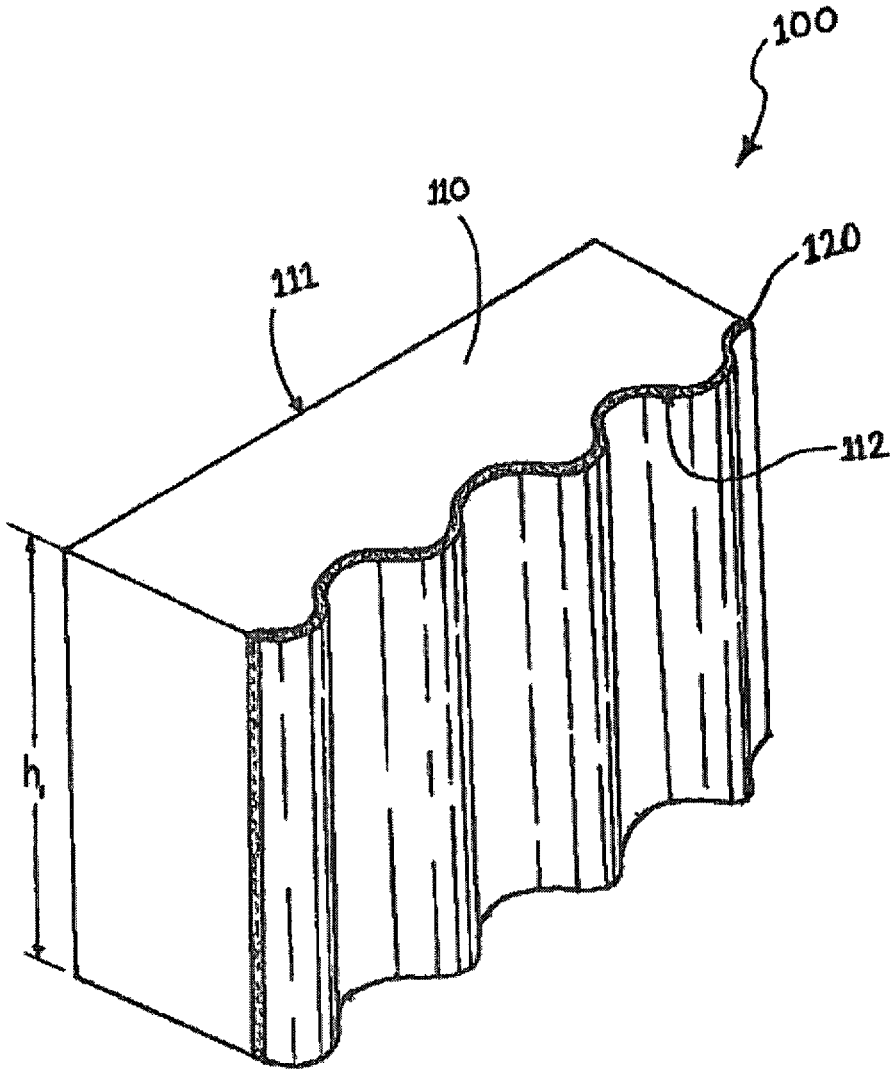
FIG. 3 is a perspective view of a hottop sideboard according to one embodiment of the present invention.
Figure 4:
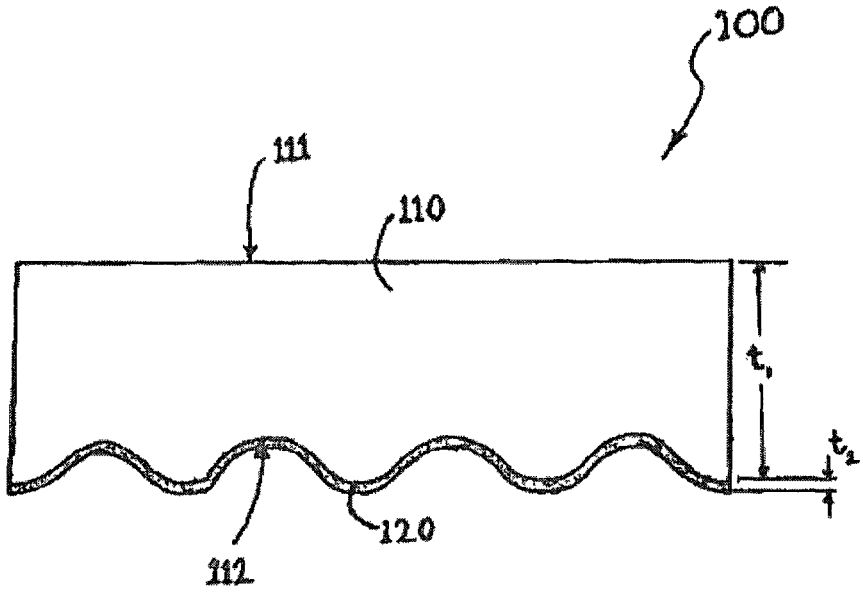
FIG. 4 is a top view of the hottop sideboard of FIG. 3.

Referring first to FIGS. 3-4 concurrently, a hottop sideboard 100 according to one embodiment of the present invention is illustrated. The hottop sideboard 100 generally comprises a first layer 110 of a rigid refractory material and a second layer 120 of a flexible refractory material.

The rigid refractory material of the layer 110 can be formed from a plurality of ceramic (or mineral) fibers that are held together with binders to form a solid board that maintains its stability, rigidity and shape at high temperatures.

The flexible refractory material of the layer 120 is preferably a blanket of ceramic fiber. The ceramic fiber blanket is also fabricated from ceramic (or mineral) fibers but at a density that is significantly lower than the ceramic (or mineral) rigid refractory hottop board, thereby resulting in a layer that is compressible and softer than the rigid refractory hottop board. Thus, the ceramic fiber blanket is flexible and easy to bend and compress to fit into tight places and onto irregularly-shaped objects. The ceramic fiber blanket will also cut heat losses in general and are most effective in reducing heat losses arising from conduction at lower temperatures. However, because the ceramic fiber blanket will not readily maintain its shape and will separate from connectors and adhesives, it is used in conjunction with the rigid layer 110.

While ceramic fiber is the preferred refractory materials for the rigid and flexible layers 110, 120, including without limitation, alumina-silica, polycrystalline fiber, silica and other refractory sands, wollastonite, mineral wool, kaolin, and KAOWOOL. Of course, other refractory materials can be used if desired, so long as the selected refractory materials can withstand the required temperatures for manufacturing the desired metal ingots.

The hottop sideboard 100 is preferably constructed so that the rigid layer 110 and the flexible layer 120 are integrally connected so as to form a monolithic/unitary structure that will not separate. The creation of an integral two layer refractory material can be achieved through the use of a fused binder material and fiber entanglement during the casting process. One suitable method of manufacturing such an integral two-layer refractory structure is disclosed in U.S. Pat.

No. 6,248,677, issued Jun. 19, 2001, the entirety of which is hereby incorporated by reference. Of course other suitable methods can be used, such as the one disclosed in U.S. Provisional Patent Application 60/157,935, filed Oct. 6, 1999 entitled COMBINED FIBER BLANKET AND FIBER BOARD MATERIAL AND METHOD FOR MAKING THE SAME, the entirety of which is hereby incorporated by reference.

Of course, in some embodiments of the invention, the rigid layer 110 and the flexible layer 120 may be joined together by a mechanical, chemical, adhesive or other bond. For example, the rigid layer 110 may be glued to the flexible layer 120 or fastened using traditional mechanical fasteners, such as clamps, bolts, nails, hook and loop, staples, etc. In still other embodiments, it may be possible for the rigid layer 110 and the flexible layer 120 to not be attached to one another but to merely rather compress the flexible layer 120 between the mold wall and the rigid layer 110 during installation. This, however, is believed to be less desirable in certain situations but still within the scope of the invention.

In the preferred integral embodiment, the monolithic and unitary nature of the rigid layer 110 and the flexible layer 120 eliminates the need for using ceramic adhesives to connect the layers 110, 120 when installed in a steel ingot mold. The integral connection between the layers 110, 120 also prevents thermal expansion from separating the layers 110, 120 during steel ingot manufacturing. Thus, molten steel can not penetrate between the layers 110, 120.

Because the inner surface 111 of the rigid layer 110 will be in contact with the molten steel, the inner surface 111 of the rigid layer 110 is preferably a substantially smooth planar surface. The outer surface 112 of the rigid layer 110 is preferably contoured so as to generally correspond to wall surface of the mold to which it will be connected. In the illustrated embodiment, the outer surface 112 of the rigid layer is corrugated, thereby comprising a plurality of undulations. Of course, the surfaces characteristics of the rigid layer 110 are not limiting of the present invention. In some embodiments, for example, the rigid layer 110 may be a flat plate-like board or a curved board having flat surfaces. Curved boards are useful when the mold has a generally cylindrical cavity.

As discussed above, the flexible layer 120 is integrally connected to the outer surface 112 of the rigid layer 110. Because the flexible layer 120 is flexible and compressible, the flexible layer 110 will conform to the inner surface of the sidewalls of a mold to which the sideboard 100 is connected due to compression. Thus, the need for extremely tight tolerances in creating the outer surface 112 of the rigid layer 110 are eliminated while simultaneously increasing the necessary tight fit between the sideboard 100 and the sidewalls of the mold that prohibits molten steel from seeping between the two and creating the unwanted fins.

In a preferred embodiment, the thickness $t_1$ of the rigid layer 110 is between ½ inch to 10 inches while the thickness $t_2$ of the flexible layer 120 is between ⅛ to 5 inches. Most preferably, the thickness $t_1$ of the rigid layer 110 is between 0.5 and 2 inches while the thickness $t_2$ of the flexible layer 120 is between ⅛ inch to ¾ inch. The height $h_1$ of the rigid layer 110 is preferably between ½ to 3 feet. Of course, these dimensions are in no way limiting. The flexible layer 120 can extend along the entire height $h_1$ of the rigid layer 110 or can only extend a portion thereof. Of course, the invention is not limited to any specific dimensions. In one embodiment, the thickness of the rigid layer 110 and the flexible layer 120 are chosen so that the insulating properties of the sideboard are substantially equal to the insulating properties of the mold in which it will be placed. It should be noted, however, that in some embodiments the existence of the flexible layer 120 is not intended to serve any substantial thermal purpose but is intended to stop finning by eliminating unwanted gaps and voids.

Figure 5:
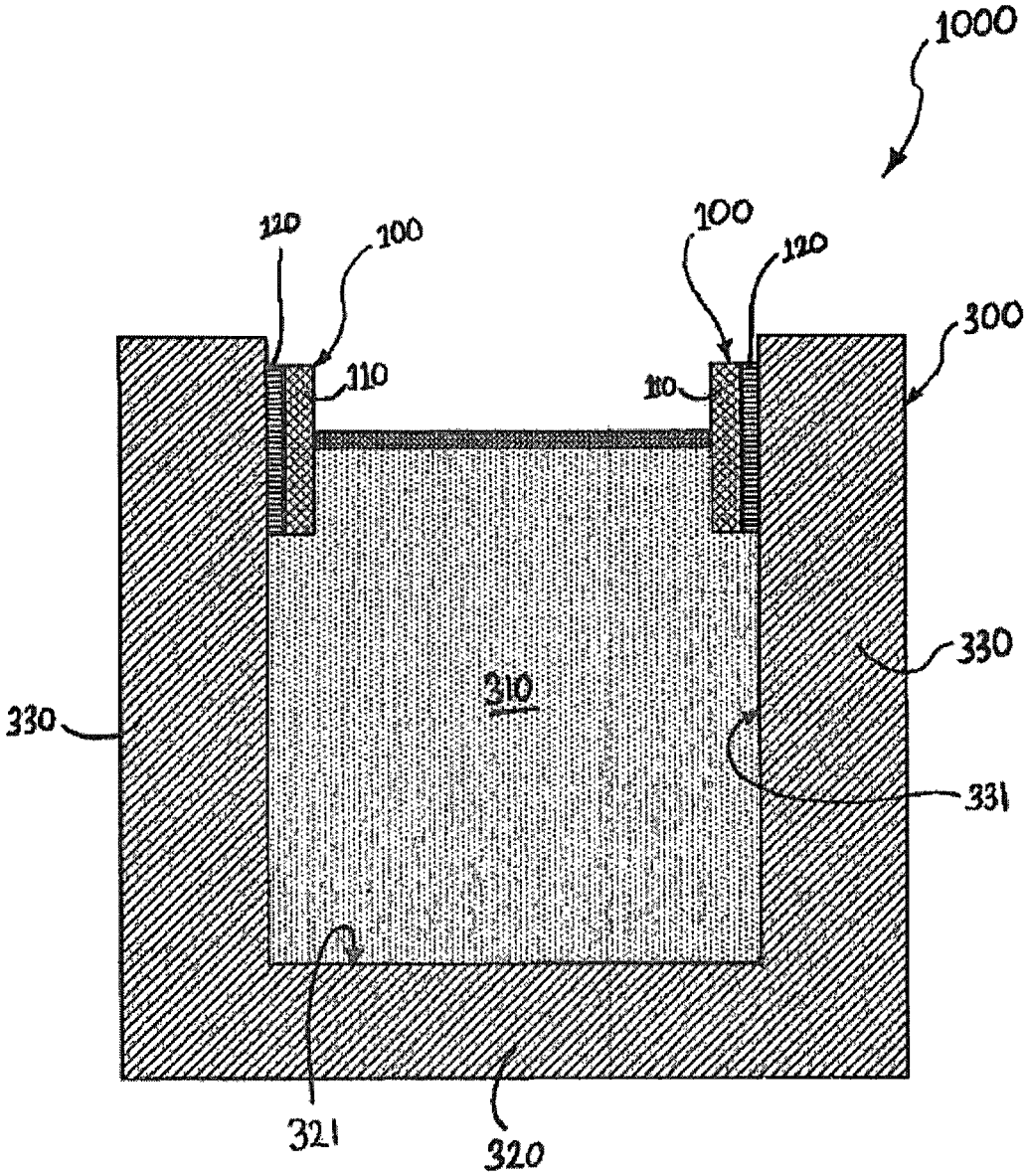
FIG. 5 is a schematic of a mold for manufacturing steel ingots according to one embodiment of the present invention that utilizes the hottop sideboard of FIG. 3.
Figure 6:
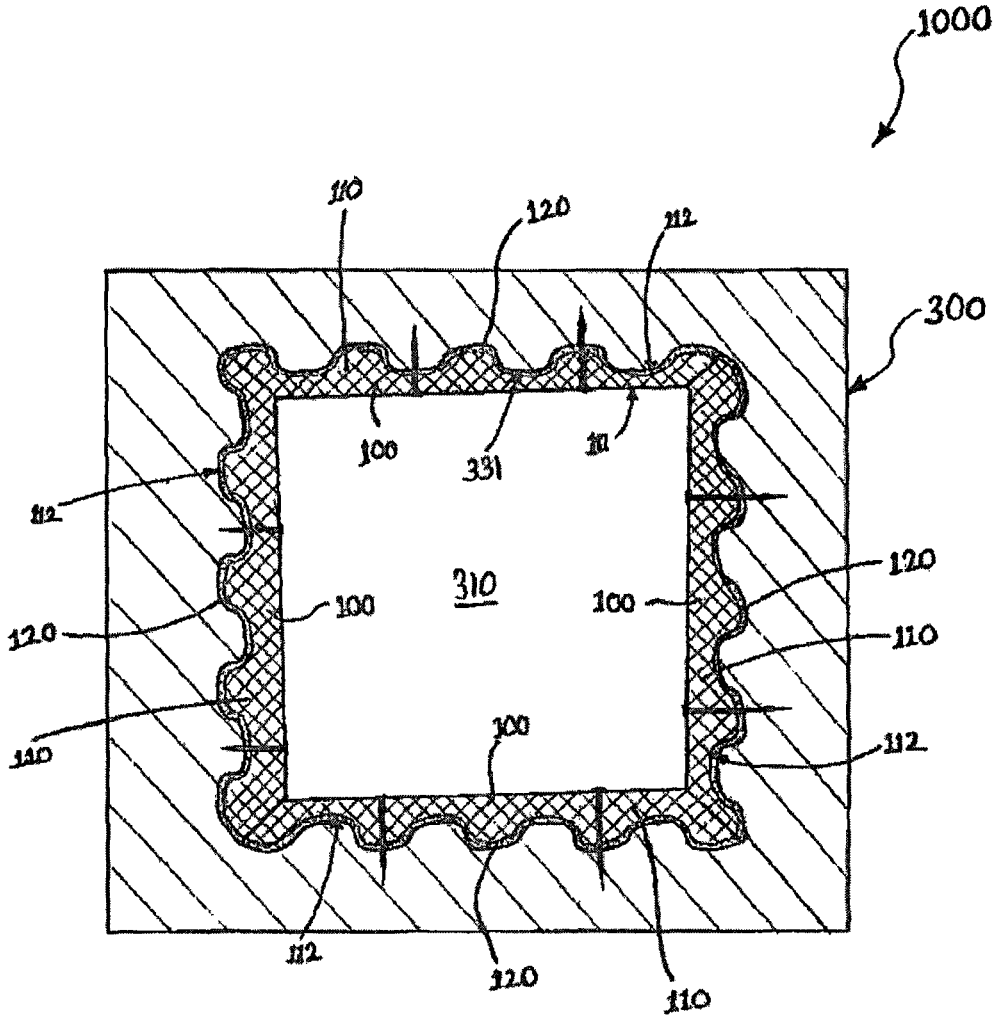
FIG. 6 is a top view of a portion of the mold of FIG. 5 showing the connection of the hottop sideboard to the sidewall of the mold body according to one embodiment of the present invention.

Referring now to FIGS. 5 and 6 concurrently, a mold 1000 for creating steel ingots is illustrated according to an embodiment of the invention. The mold 1000 comprises a body structure 300 that forms a cavity 310 for receiving and cooling molten steel. More specifically, the body structure 300 comprises a floor portion 320 and sidewalls 330. The wall surface 331 of the sidewalls and the floor surface 321 of the floor portion 320 form the open ended cavity 310. The wall surface 331 of the sidewalls 330 is a corrugated surface comprising a plurality of vertically oriented undulations. Of course, the topography of the wall surface 331 can take on a wide variety of characteristics and is not limiting of the invention in certain embodiments.

The size and shape of the cavity 310 is determined by the desired steel ingot to be produced. For example, the cavity 310 can be cylindrical, prismatic, or any other desired three-dimensional shape.

One or more sideboards 100, as described in FIGS. 3-4 above, are secured to the sidewalls 330 at or near a top of the cavity 310. The exact height of the sideboards 100 above the floor surface 321 will be dictated by the desired height of the steel ingot to be produced. The sideboards 100 are connected to the sidewalls 330 so as to form a perimeter about the wall surface 331. For example, if the cavity 310 has a circular horizontal cross-section, the sideboards will form a circular ring-like structure about the wall surface 331. On the other hand, if the cavity 310 has a rectangular horizontal cross-section, the sideboards 100 will form a rectangular ring-like structure about the wall surface 331.

The perimeter of sideboards 100 can be formed by using a plurality of individual sideboards 100 each connected to a separate sidewall 330 or portion thereof. Alternatively, a single sideboard perimeter structure may be created and fastened to the sidewall 330.

As discussed above, the sideboards 100 comprise a flexible layer 120 of a ceramic fiber blanket and a rigid layer 110 of a rigid refractory hottop board. The sideboards 100 are connected to the sidewall 330 so that the flexible layer 120 is disposed between the rigid layer 110 and the wall surface 331 of the sidewall 330. As mentioned above, the outer surface 112 of the rigid layer 110 is contoured with undulations that correspond to the undulations in the wall surface 331. The sideboards 100 are secured to the sidewalls 330 so that the flexible layer 120 is compressed between the rigid layer 110 and the wall surface 331, thereby forming a very tight fit that does not allow any molten steel to penetrate between the sideboard 100 and the sidewall 330. Thus, the occurrence of fins is eliminated and/or reduced during the molten steel cooling and solidification process. Preferably, the flexible layer 120 is compressed so that its thickness $t_2$ is reduced by 25% to 75% as compared to its uncompressed state, and more preferably between 40% to 50%.

The compression of the flexible layer 110 eliminates the need for tight tolerances of the rigid layer 120 during the creation and assembly of the sideboards 100 to the sidewalls 330. Moreover, as the main body structure 300 of the cast iron mold 1000 deforms from aging, the flexible layer 120 is more forgiving in that it will conform to these irregularities and changes naturally.

The sideboards 100 can be connected to the sidewalls 330 via nails, screws, bolts or other fasteners. In a preferred embodiment, a nail gun system capable of shooting a nail into steel is used to connect the sideboards 100 to the mold walls 330, such as a cartridge (i.e., gunpowder) actuated nail gun made by Hilti. In one embodiment, it is preferred that the fastener be a nail and washer combination. By utilizing a nail that can be shot through a washer, the nail will penetrate the sideboards 100 and the metal mold walls 330. The washer will distribute the force applied to the rigid layer 110 and assist in the substantial compression of the flexible layer 120. In one successful embodiment, a 1.5 inch washer is used with a 2 inch nail.

The use of the hottop sideboard 100 with integrated ceramic fiber blanket with ceramic fiber board as a monolithic material has been used in cast iron molds that are 70 inches wide×34 inches long×126 inches high with a typical mold cavity of 20 tons of steel ingot. The additional cost to manufacture the monolithic materials is not excessive, and therefore, the invention has substantial value to the steel mill.

Moreover, the description and illustration of the invention is an example and the invention is not limited to the exact details shown or described. This concept could be used for manufacture of sideboards used in other industries besides the manufacturing of steel ingots. The concept could also be used to manufacture a wide variety of shapes.

What is claimed is:

1. A method of manufacturing metal ingots comprising:

a) providing a mold comprising a main body having a floor and sidewalk that form a cavity;

b) providing a plurality of sideboards comprising a first layer of a rigid refractory material and a second layer of a flexible refractory material, the first layer and the second layer integrally formed as a monolithic structure from, the same refractory material via a casting process, the first layer having a density that is greater than the second layer, wherein the rigid refractory material is a fiber ceramic board and the flexible refractory material is a fiber ceramic blanket;

c) securing the sideboards to the sidewalk so as to form a perimeter about the cavity in a spaced relation from the floor, the sideboards secured to the sidewalls so that the second layer is compressed between the first layer and the sidewall;

d) pouring molten metal into the cavity until a surface level of the molten metal is above a bottom edge of the sideboards and below a top edge of the sideboard;

e) covering the surface level of the molten metal with an insulating powder; and f) allowing the molten metal to cool.

2. The method of claim 1 wherein the sidewalk of the mold are constructed of a metal.

3. The method of claim 1 wherein the casting process utilizes vacuum-foaming.

4. The method of claim 1 wherein the casting process achieves fiber entanglement between fibers of the first layer and fibers of the second layer.

5. The method of claim 1 further wherein the first layer has a first surface and a second surface, the second layer integrally connected to the second surface; and wherein the second surface of the first layer is corrugated surface.

6. The method of claim 1 further comprising:

the rigid refractory material being a fiber ceramic board and the flexible refractory material being a fiber ceramic blanket; and wherein step (c) comprises inserting a plurality of fasteners through the sideboards and into the sidewalls, the fasteners comprising a washer element and a spike element, the washer elements compressed against a first surface of the first layer of the sideboards and the spike element extending through the sideboards and into the sidewalls.

7. A method of manufacturing metal ingots comprising:

a) providing a mold comprising a main body having a floor and sidewalls that form a cavity;

b) providing a plurality of sideboards comprising a rigid layer of an alumina-silica fiber ceramic board and a flexible layer of an alumina-silica fiber ceramic blanket, the rigid layer and the flexible layer integrally formed as a monolithic structure using a casting process that results in fiber entanglement;

c) securing the sideboards to the sidewalls so as to form a perimeter about the cavity in a spaced relation from the floor, the sideboards secured to the sidewalls so that the flexible layer is compressed between the rigid layer and the sidewall;

d) pouring molten metal into the cavity until a surface level of the molten metal is above a bottom edge of the sideboards and below a top edge of the sideboard; and e) allowing the molten metal to cool.

8. The method of claim 7 wherein the rigid layer has a density that is greater than the flexible layer.

9. The method of claim 7 wherein the integral formation prevents thermal expansion from separating the rigid layer and the flexible layer.

10. A method of manufacturing metal ingots comprising:

a) forming a plurality of monolithic sideboards using a casting process, each of the monolithic sideboards comprising a layer of a fiber ceramic blanket and a layer of a fiber ceramic board that are integrally connected, at least in part, via fiber entanglement;

b) securing the plurality of monolithic sideboards to sidewalls of a mold so as to form a perimeter about a cavity of the mold and so that the layers of the fiber ceramic blankets are compressed between the rigid layers and the sidewalk;

c) pouring molten metal into the cavity until a surface level of the molten metal is above a bottom edge of the monolithic sideboards and below a top edge of the monolithic sideboards; and d) allowing the molten metal to cool.

11. The method of claim 10 wherein the casting process utilizes a vacuum formation technique.

12. The method of claim 10 wherein the fiber ceramic board and the fiber ceramic blanket are formed of the same material, the fiber ceramic board having a density that is greater than the fiber ceramic blanket.

13. The method of claim 12 wherein the flexible layer and the rigid layer are formed an alumina-silica fiber ceramic.

* * * * *